US009870881B2

(12) United States Patent
Nishino

(10) Patent No.: US 9,870,881 B2
(45) Date of Patent: Jan. 16, 2018

(54) KEYBOARD DEVICE

(71) Applicant: FUJITSU COMPONENT LIMITED, Tokyo (JP)

(72) Inventor: Takeshi Nishino, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 119 days.

(21) Appl. No.: 13/869,573

(22) Filed: Apr. 24, 2013

(65) Prior Publication Data

US 2013/0284573 A1 Oct. 31, 2013

(30) Foreign Application Priority Data

Apr. 26, 2012 (JP) ..... 2012-101878

(51) Int. Cl.

| | |
|---|---|
| ***H01H 13/70*** | (2006.01) |
| ***H01H 13/10*** | (2006.01) |
| ***H01H 3/12*** | (2006.01) |
| ***H01H 3/40*** | (2006.01) |

(52) U.S. Cl.

CPC ..... *H01H 13/10* (2013.01); *H01H 3/122* (2013.01); *H01H 3/40* (2013.01)

(58) Field of Classification Search

CPC ..... H01H 3/122; H01H 3/125; H01H 13/10; H01H 13/704; H01H 13/705; H01H 13/7065; H01H 3/40

USPC ..... 200/344, 345

See application file for complete search history.

(56) References Cited

U.S. PATENT DOCUMENTS

| | | | | |
|---|---|---|---|---|
| 5,657,860 | A | 8/1997 | Koike et al. | |
| 5,813,521 | A | 9/1998 | Koike et al. | |
| 6,257,782 | B1 | 7/2001 | Maruyama et al. | |
| 7,417,200 | B2 * | 8/2008 | Hsu | 200/5 A |
| 8,101,879 | B2 * | 1/2012 | Nishino | 200/344 |
| 8,299,382 | B2 * | 10/2012 | Takemae et al. | 200/344 |
| 8,791,378 | B2 * | 7/2014 | Lan | 200/5 A |
| 2001/0002647 | A1 | 6/2001 | Hayashi et al. | |
| 2002/0096424 | A1 * | 7/2002 | Chun | H01H 3/125 200/344 |
| 2003/0213684 | A1 * | 11/2003 | Chun | H01H 13/38 200/344 |
| 2006/0006052 | A1 | 1/2006 | Takahashi | |
| 2008/0035461 | A1 | 2/2008 | Nishino | |
| 2009/0078552 | A1 | 3/2009 | Takemae et al. | |

FOREIGN PATENT DOCUMENTS

| | | |
|---|---|---|
| CN | 101123144 | 2/2008 |
| CN | 101393809 | 3/2009 |
| JP | 9-190735 | 7/1997 |

(Continued)

OTHER PUBLICATIONS

Patent Abstracts of Japan, Publication No. 2009-32702, Published on Feb. 12, 2009.

(Continued)

*Primary Examiner* — Edwin A. Leon
*Assistant Examiner* — Lheiren Mae A Caroc
(74) *Attorney, Agent, or Firm* — Staas & Halsey LLP

(57) ABSTRACT

A keyboard device includes: a key top; a pair of link members coupled with the key top; and a support panel that is located below the key top, and includes first holes each housing a part of the link members.

7 Claims, 8 Drawing Sheets

(56) References Cited

FOREIGN PATENT DOCUMENTS

| | | |
|---|---|---|
| JP | 2000-173389 | 6/2000 |
| JP | 2000-260254 | 9/2000 |
| JP | 2001-155580 | 6/2001 |
| JP | 2009-32702 | 2/2009 |
| JP | 2009-54594 | 3/2009 |
| WO | 2004/114343 A1 | 12/2004 |

OTHER PUBLICATIONS

Espacenet English Abstract of Chinese Publication No. 101123144, Published on Feb. 13, 2008.
Espacenet English Abstract of Chinese Publication No. 101393809, Published on Mar. 25, 2009.
Chinese Office Action dated Nov. 4, 2014 in corresponding Chinese Patent Application No. 201310148799.4.
Patent Abstracts of Japan, Publication No. 2000-173389, Published Jun. 23, 2000.
Patent Abstracts of Japan, Publication No. 2001-155580, Published Jun. 8, 2001.
Japan Platform for Patent Information English Abstract of Japanese Publication No. 2009-54594, published Mar. 12, 2009.
Japan Platform for Patent Information English Abstract of Japanese Publication No. 9-190735, published Jul. 22, 1997.
Japan Platform for Patent Information English Abstract of Japanese Publication No. 2000-260254, published Sep. 22, 2000.
Japanese Office Action dated Feb. 2, 2016 in corresponding Japanese Patent Application No. 2012-101878.

* cited by examiner

KEYBOARD DEVICE

CROSS-REFERENCE TO RELATED APPLICATION

This application is based upon and claims the benefit of priority of the prior Japanese Patent Application No. 2012-101878 filed on Apr. 26, 2012, the entire contents of which are incorporated herein by reference.

FIELD

A certain aspect of the embodiments is related to a keyboard device.

BACKGROUND

A keyboard device is widely used as an input device of an electronic device such as a personal computer. For example, Japanese Laid-open Patent Publication No. 2000-173389 discloses a technique in which a pair of members having a gear mechanism are provided on a sheet. Japanese Laid-open Patent Publication No. 2001-155580 discloses a technique in which a key top moves up and down by rotationally moving a decussate member. Recently, a portable electronic device such as a note-type personal computer (i.e., a notebook PC) is widely used. For convenience of portability, weight saving and downsizing are required of the electronic device. In view of this, thinness is required of the keyboard device.

SUMMARY

According to an aspect of the present invention, there is provided a keyboard device including: a key top; a pair of link members coupled with the key top; and a support panel that is located below the key top, and includes first holes each housing a part of the link members.

The objects and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the above-mentioned technique, the whole keyboard device may be thinned by making parts of the keyboard device thin. However, in this case, there is a possibility that the operation of the keyboard device is spoiled.

Figure 1A:
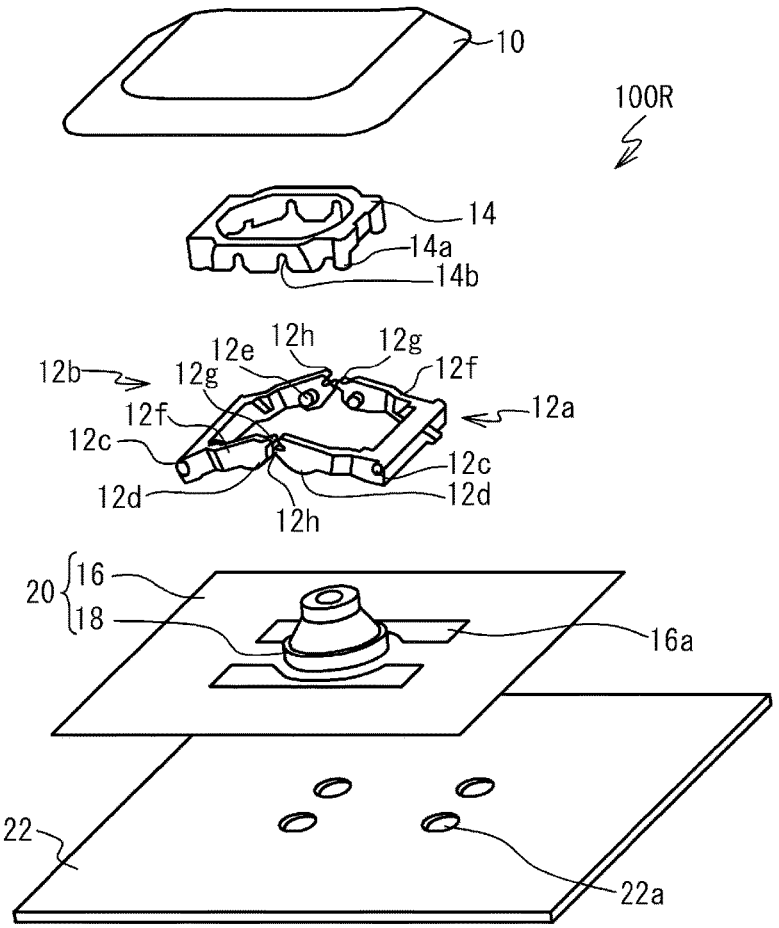
FIG. 1A is an exploded perspective view illustrating a keyboard device according to a comparative example.
Figure 1B:
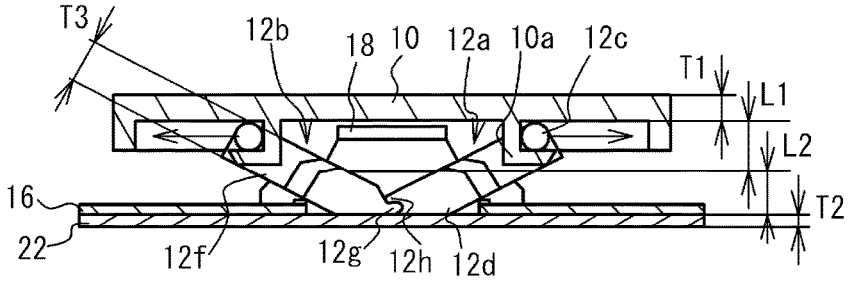
FIG. 1B is a cross-section view illustrating the keyboard device at the time of non-depression.

First, a description will be given of a comparative example. FIG. 1A is an exploded perspective view illustrating a keyboard device 100R according to the comparative example. FIG. 1B is a cross-section view illustrating the keyboard device 100R at the time of non-depression. In FIG. 1B, a part of a hook 10*a* is permeated, and projections 12*c* are illustrated.

As illustrated in FIGS. 1A and 1B, the keyboard device 100R a key top 10, two gear links 12*a* and 12*b* (link members), a housing 14, a membrane switch 20, and a support panel 22. The membrane switch 20 includes a membrane 16 and an operating member 18 provided on the membrane 16.

The support panel 22 is arranged below the key top 10, and the membrane switch 20 is arranged between the key top 10 and the support panel 22. An upper surface of the support panel 22 is opposed to the key top 10. Four holes 22*a* are provided on the support panel 22. The upper surface of the support panel 22 and the holes 22*a* are exposed from holes 16*a* provided on the membrane 16.

As illustrated in FIG. 1B, edge portions 12*d* of the gear links 12*a* and 12*b* by the side of the support panel 22 contact the upper surface of the support panel 22 exposed from the holes 16*a*. The housing 14 is arranged on the edge portions 12*d*, and base portions 14*a* of the housing 14 are housed into the holes 22*a*. The projections 12*e* are arranged under arch portions 14*b* of the housing 14, and are sandwiched between the housing 14 and the support panel 22. Thereby, the gear links 12*a* and 12*b* are fixed to the support panel 22.

A first tooth 12*g* is provided on one edge portion 12*d* (of a back side in FIG. 1A) of the gear link 12*a*, and a second tooth 12*h* is provided on another edge portion 12*d* (of a near side). The first tooth 12*g* and the second tooth 12*h* are provided on the gear link 12*b*. The first tooth 12*g* of the gear link 12*a* engages with the second tooth 12*h* of the gear link 12*b*, and the second tooth 12*h* of the gear link 12*a* engages with the first tooth 12*g* of the gear link 12*b*. Thus, a pair of the gear links 12*a* and 12*b* are coupled to each other via the edge portions 12*d*, and can operate simultaneously with each other.

Arm portions 12*f* extend towards the key top 10 from the edge portions 12*d*. The hooks 10*a* are projected from a lower surface of the key top 10. Projections 12*c* are provided on edge portions (by the side of the key top 10) opposed to the edge portions 12*d*. The projections 12*c* engage with the hooks 10*a*, so that the key top 10 is coupled to the gear links 12*a* and 12*b*. Surfaces facing the outside of the key top 10 of the hooks 10*a* are opened. In a distance from the key top 10 to the support panel 22, the length of the gear link 12*a* is the same as that of the gear link 12*b*, for example.

When the key top 10 is not depressed (non-depression time), the two gear links 12*a* and 12*b* are assembled like a shape of a V-character, and support the key top 10, as illustrated in FIG. 1B. For example, when the key top 10 is depressed (depression time) by a user's finger, the lower surface of the key top 10 depresses the operating member 18. Thereby, the membrane switch 20 is operated. When the finger is lifted from the key top 10, the key top 10 is pushed up by an upward elastic force of the operating member 18. The edge portions of the gear links 12*a* and 12*b* by the side of the key top 10 slide in a horizontal direction in response to the depression of the key top 10, as illustrated in arrows of FIG. 1B. The arm portions 12*f* fall downward. The gear links 12*a* and 12*b* guide the key top 10 in up-and-down directions while keeping the key top 10 horizontally.

The thickness of the keyboard device 100R is the sum of the thickness T1 of the key top 10, a stroke L1, a distance L2, and the thickness T2 of the support panel 22, for example. The stroke L1 is a distance in which the key top 10 is depressed. The distance L2 is a distance from the upper surface of the support panel 22 to the upper surface of the edge portions 12*d*. In order to make the operation of the keyboard device 100R favorable, it is required that the stroke L1 maintains a certain degree of size. For example, the edge portions 12*d* become thin by making the thickness T3 of the gear links 12*a* and 12*b* small. Thereby, the distance L2 can be made small. However, when the gear links 12*a* and 12*b* are too thin, it is difficult to secure the thickness of the first tooth 12*g* and the second tooth 12*h*. As a result, it is difficult to form the first tooth 12*g* and the second tooth 12*h*. Moreover, the rigidity of the gear links 12*a* and 12*b* becomes reduced. Therefore, a function of the gear links 12*a* and 12*b* that support the key top 10 and operate simultaneously with each other deteriorates. Thereby, the operation of the keyboard device 100R is not performed smoothly.

First Embodiment

Figure 2:
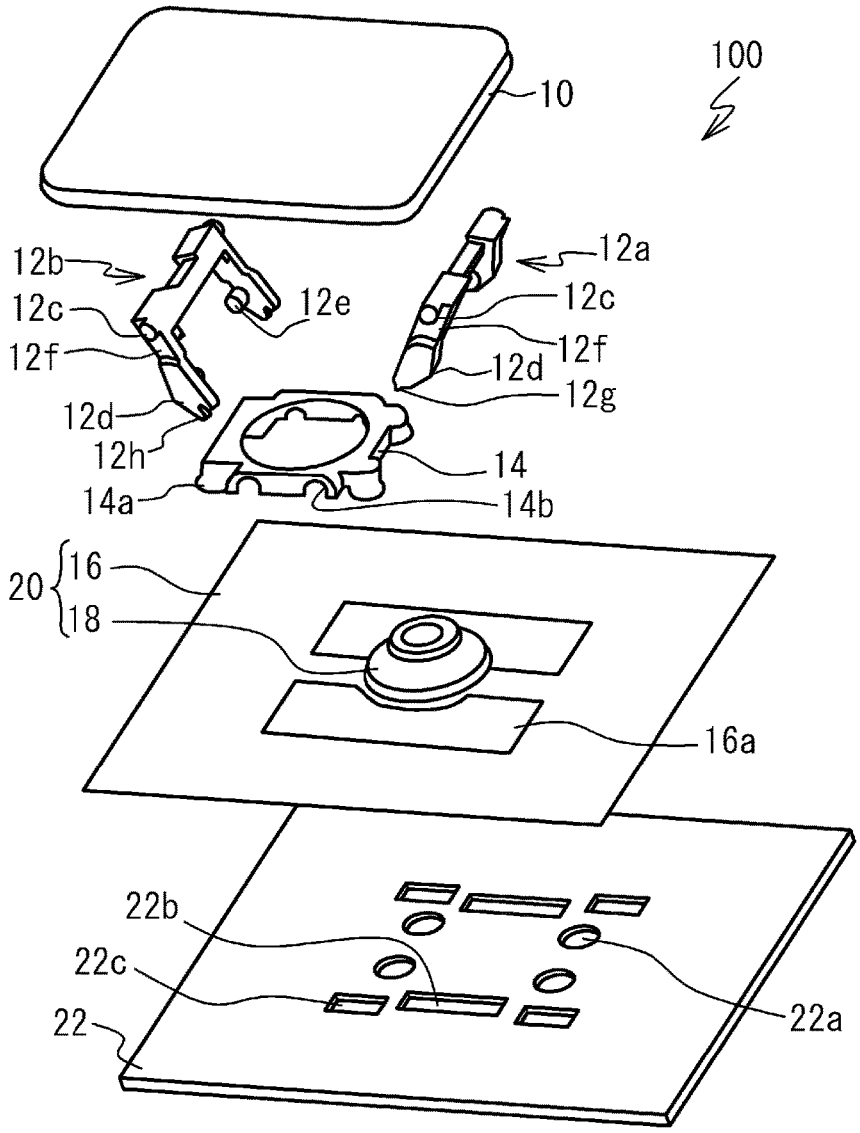
FIG. 2 is an exploded perspective view illustrating the keyboard device according to a first embodiment.
Figure 3A:
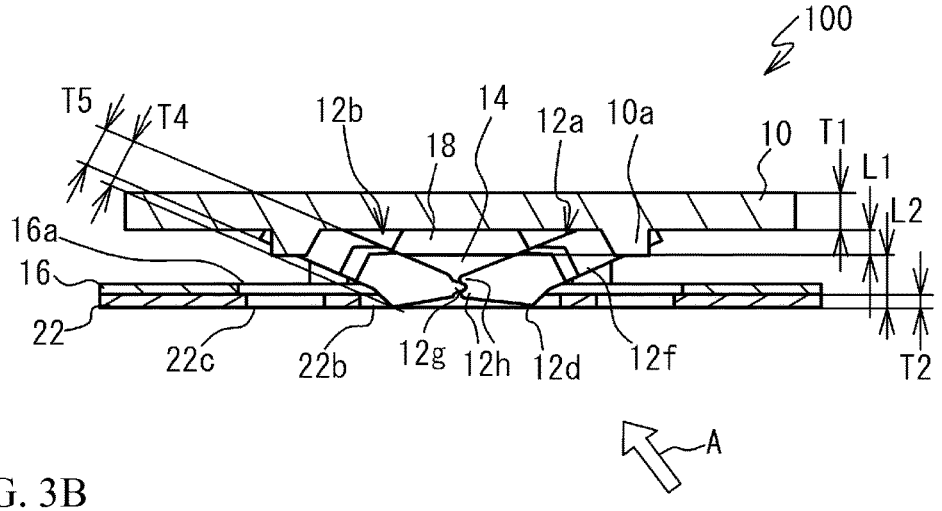
FIG. 3A is a cross-section view illustrating the keyboard device at the time of non-depression.
Figure 3B:
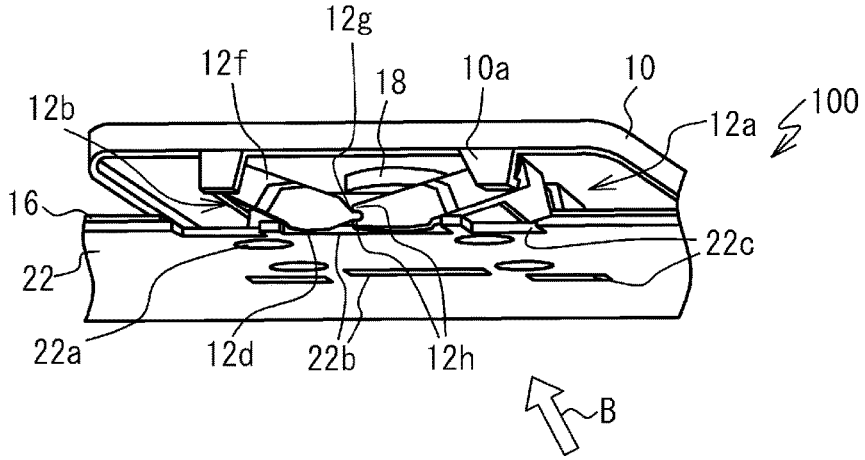
FIG. 3B is a perspective view seen from an arrow A of FIG. 3A.
Figure 3C:
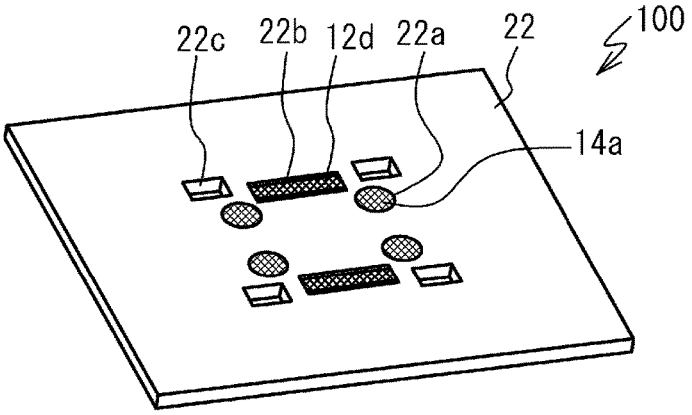
FIG. 3C is a rear view seen from an arrow B of FIG. 3B.
Figure 4A:
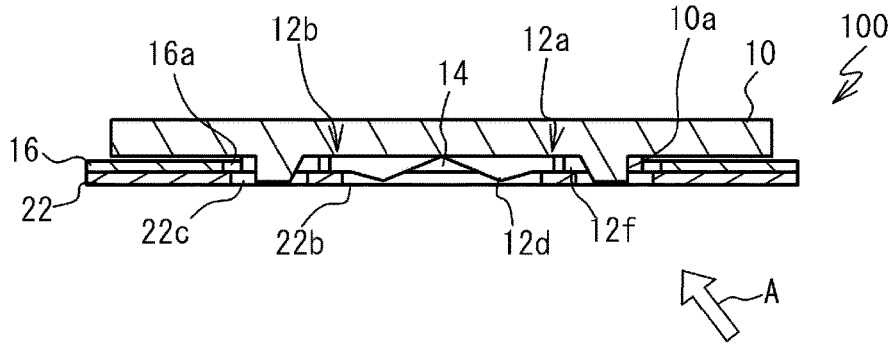
FIG. 4A is a cross-section view illustrating the keyboard device at the time of depression.
Figure 4B:
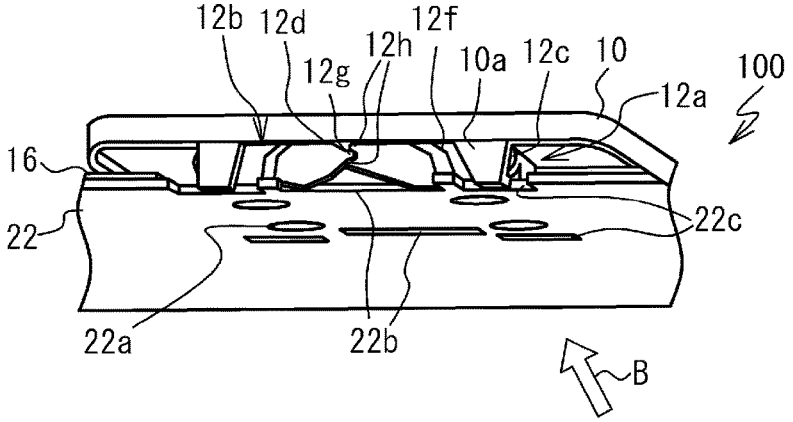
FIG. 4B is a perspective view seen from an arrow A of FIG. 4A.
Figure 4C:
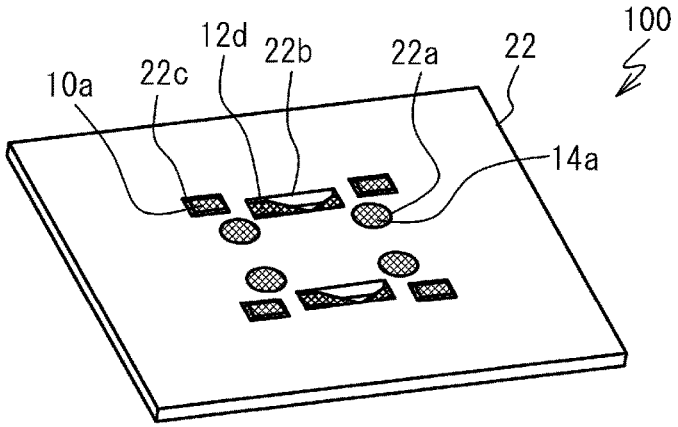
FIG. 4C is a rear view seen from an arrow B of FIG. 4B.

A first embodiment is an example of housing the edge portions 12*d* into the holes 22*b* of the support panel 22. FIG. 2 is an exploded perspective view illustrating a keyboard device 100 according to the first embodiment. FIG. 3A is a cross-section view illustrating the keyboard device 100 at the time of non-depression. FIG. 3B is a perspective view seen from an arrow A of FIG. 3A. FIG. 3C is a rear view seen from an arrow B of FIG. 3B. FIG. 4A is a cross-section view illustrating the keyboard device 100 at the time of depression. FIG. 4B is a perspective view seen from an arrow A of FIG. 4A. FIG. 4C is a rear view seen from an arrow B of FIG. 4B. In FIG. 3C, checked lattice lines are given to the gear links 12*a* and 12*b* and the base portion 14*a*. In FIG. 4C, checked lattice lines are also given to the hooks 10*a* in addition to the above-mentioned portions.

As illustrated in FIGS. 2A to 4C, four holes 22*a*, two holes 22*b* (i.e., first holes), and four holes 22*c* (i.e., second holes) are provided on the support panel 22. The holes 22*a*, 22*b* and 22*c* are exposed through the holes 16*a* of the membrane 16. The edge portions 12*d* (i.e., first portions) of the gear links 12*a* and 12*b* (i.e., link members) are housed into the holes 22*b*, respectively.

While the edge portions 12*d* are housed by the holes 22*b* at the time of depression, as illustrated in FIGS. 4A and 4B, the arm portions 12*f* (i.e., second portions) move downward, and contact the upper surface of the support panel 22, for example. As illustrated in FIG. 4C, the hooks 10*a* (i.e., coupling portions) are housed into the holes 22*c*.

According to the first embodiment, the edge portions 12*d* are housed into the holes 22*b*, so that the distance L2 becomes short by only the thickness T2 of the support panel 22. As a result, the keyboard device 100 can be made thin. Since it is not necessary to make the stroke L1 small, the operation of the keyboard device 100 is not prevented. That is, it is possible to achieve both of thinness and favorable operation.

As illustrated in FIG. 3A, the thickness T4 of each edge portion 12*d* is larger than the thickness T5 of each arm portion 12*f*. Therefore, the first tooth 12*g* and the second tooth 12*h* are can be formed on the edge portions 12*d*, respectively. The rigidity of the gear links 12*a* and 12*b* can remain high. The gear links 12*a* and 12*b* can support the key top 10 and operate simultaneously with each other. Therefore, the operation of the keyboard device 100 becomes favorable.

When the hooks 10*a* or the edge portions 12*d* are projected from the rear surface of the support panel 22 (i.e., a surface opposite to a surface which faces the key top 10), the projected hooks 10*a* or the projected edge portions 12*d* contact a housing (not shown) arranged under the support panel 22. Thereby, the range of movement of the gear links 12*a* and 12*b* becomes small. That is, the stroke L1 becomes short and the operation of the keyboard device 100 is prevented. Therefore, it is desirable that the hooks 10*a* or the edge portions 12*d* do not project from the rear surface of the support panel 22. Thereby, shortening of the stroke L1 is restrained. For example, at the time of depression, lowest points of the edge portions 12*d* and the lower surfaces of the hooks 10*a* may be located in the same height as the rear surface of the support panel 22. Thereby, it is possible to secure thinness and the stroke L1.

Second Embodiment

Figure 5:
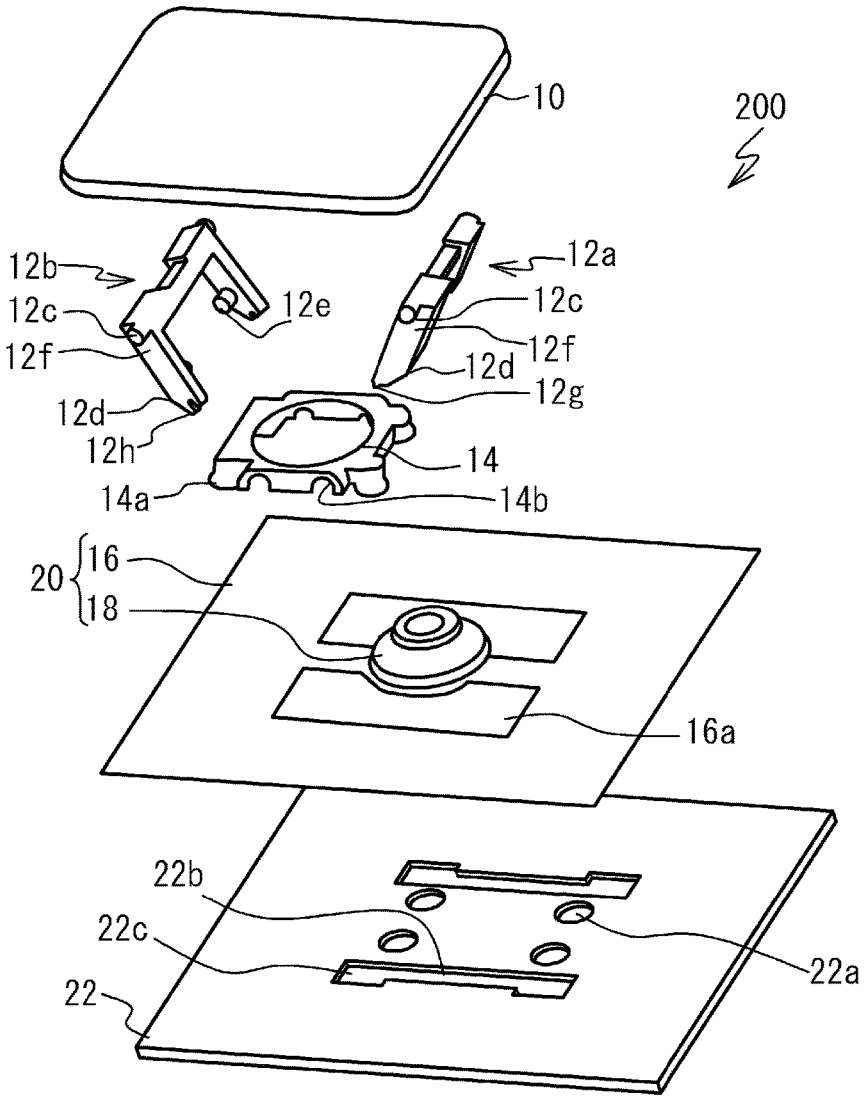
FIG. 5 is an exploded perspective view illustrating the keyboard device according to a second embodiment.
Figure 6A:
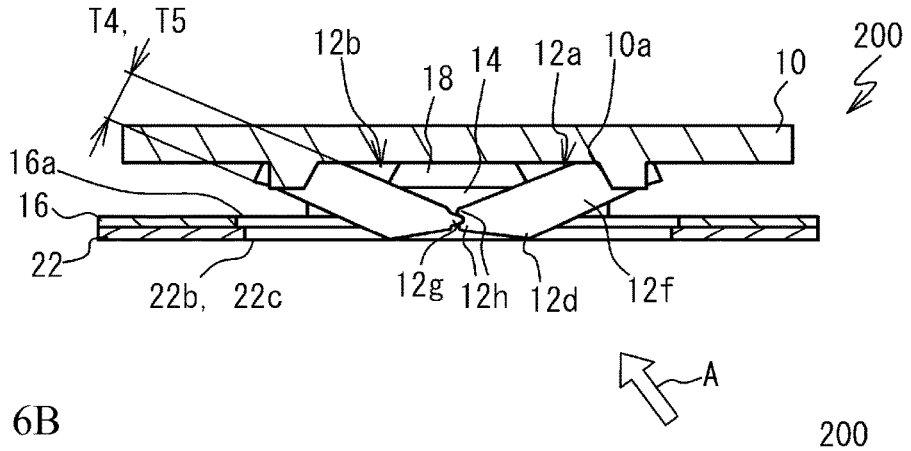
FIG. 6A is a cross-section view illustrating the keyboard device at the time of non-depression.
Figure 6B:
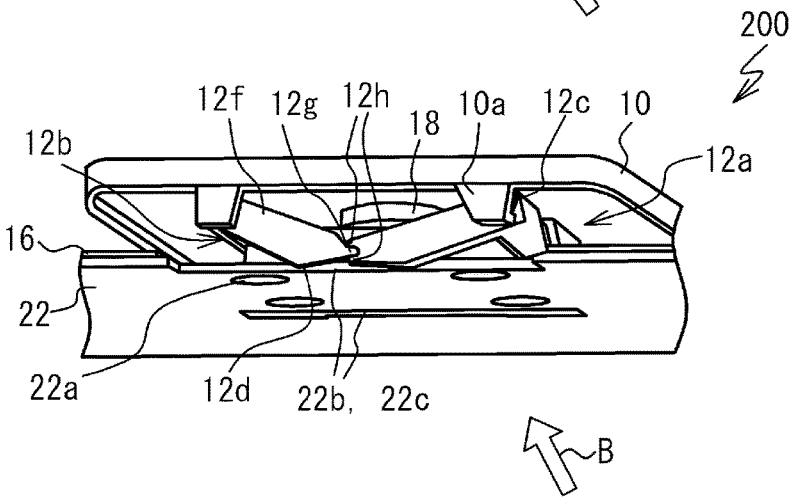
FIG. 6B is a perspective view seen from an arrow A of FIG. 6A.
Figure 6C:
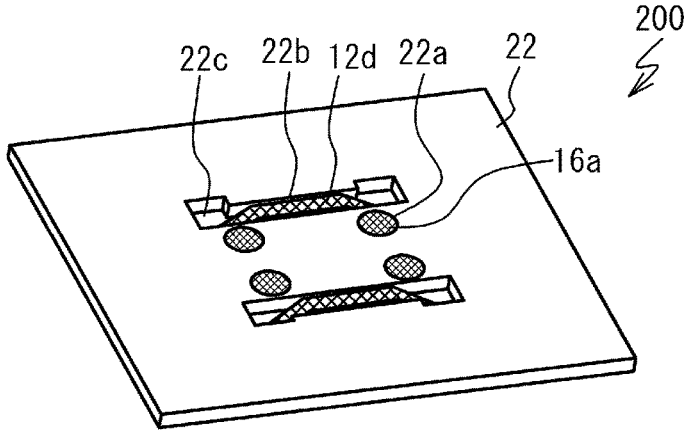
FIG. 6C is a rear view seen from an arrow B of FIG. 6B.
Figure 7A:
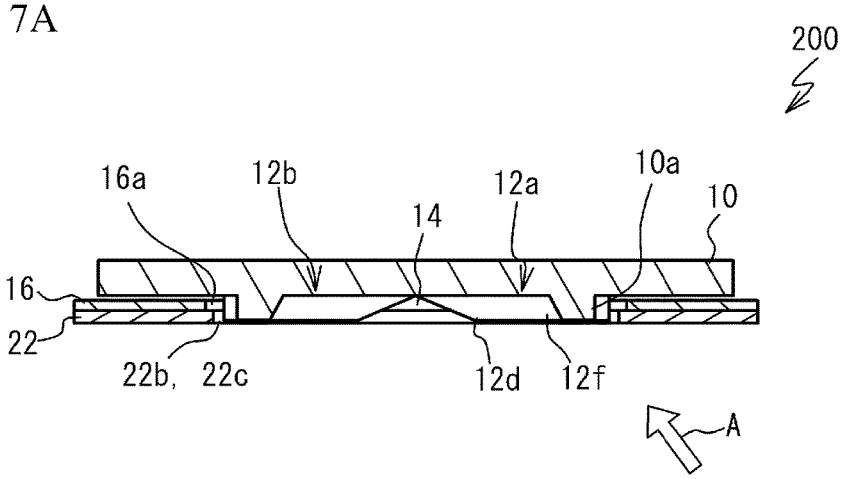
FIG. 7A is a cross-section view illustrating the keyboard device at the time of depression.
Figure 7B:
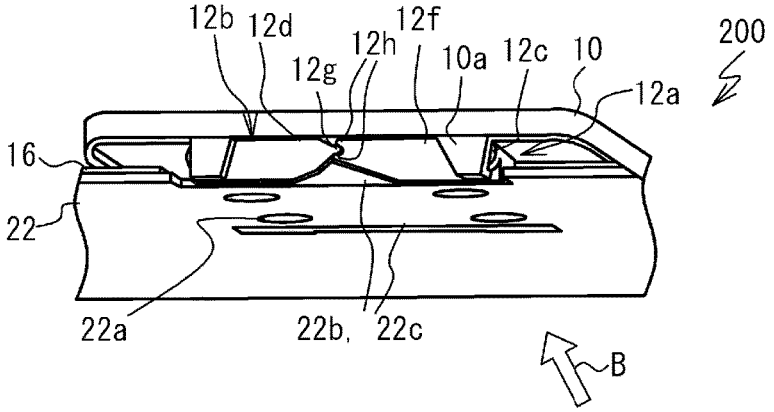
FIG. 7B is a perspective view seen from an arrow A of FIG. 7A.
Figure 7C:
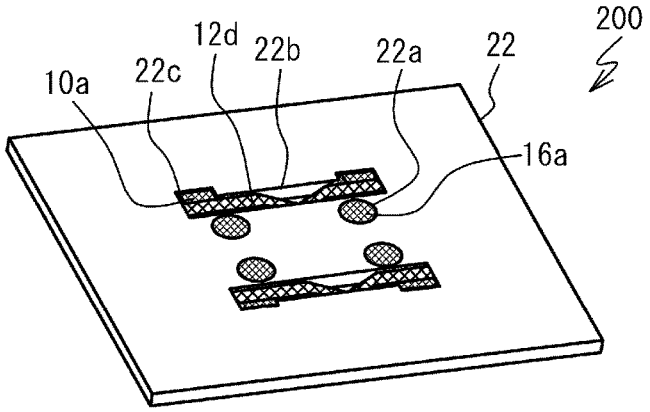
FIG. 7C is a rear view seen from an arrow B of FIG. 7B.

A second embodiment is an example in which the arm portions 12*f* are housed into the holes 22*b*. FIG. 5 is an exploded perspective view illustrating a keyboard device 200 according to a second embodiment. FIG. 6A is a cross-section view illustrating the keyboard device 200 at the time of non-depression. FIG. 6B is a perspective view seen from an arrow A of FIG. 6A. FIG. 6C is a rear view seen from an arrow B of FIG. 6B. FIG. 7A is a cross-section view illustrating the keyboard device 200 at the time of depression. FIG. 7B is a perspective view seen from an arrow A of FIG. 7A. FIG. 7C is a rear view seen from an arrow B of FIG. 7B.

The keyboard device 200 has the same structure as the keyboard device 100 except for the gear links 12*a* and 12*b*, and the support panel 22. As illustrated in FIG. 6A, the thickness T5 of the arm portions 12*f* are the same as the thickness T4 of the edge portions 12*d*. Therefore, the rigidity of the gear links 12*a* and 12*b* becomes higher, and the operation of the keyboard device 200 becomes favorable. The holes 22*b* of the second embodiment are larger than the holes 22*b* of the first embodiment, and are united with the holes 22*c*. As illustrated in FIGS. 7A to 7C, the holes 22*b* can house the edge portions 12*d* and the arm portions 12*f*, so that the keyboard device 200 can be thin. It is desirable that, at the time of depression, the edge portions 12*d*, the arm portions 12*f* and the lower surfaces of the hooks 10*a* are located in the same height as the rear surface of the support panel 22.

Figure 8:
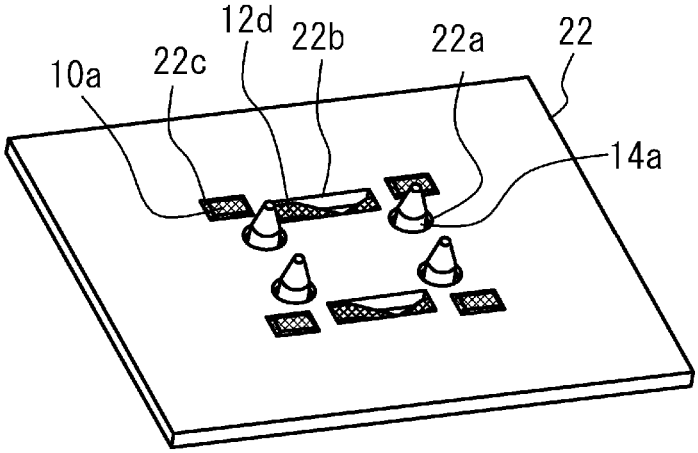
FIG. 8 is a rear view illustrating an example in which the shape of a housing is changed.

FIG. 8 is a rear view illustrating an example in which the shape of a housing 14 is changed. As illustrated in FIG. 8, the base portion 14*a* of the housing 14 may have shapes of pins that project from the rear surface of the support panel 22.

Also in the first and the second embodiments, each of the gear links 12*a* and 12*b* may have both of the first tooth 12*g* and the second tooth 12*h*, as with the comparative example. As illustrated in FIG. 3A, the gear links 12*a* and 12*b* are provided like the shape of the V-character so that the distance between the gear links from the side of the support panel 22 to the side of the key top 10 increases. However, the structure can be changed. For example, the gear links 12*a* and 12*b* may be provided like the shape of an inverted V-character so that the distance between the gear links from the side of the key top 10 to the side of the support panel 22 increases. Moreover, the edge portions 12*d* may be slid in the horizontal direction in the holes 22*b* in response to up-and-down operation of the key top 10. Although the edge portions 12*d* are housed into the holes 22*b*, the structure is not limited to this. A part of the gear links 12*a* and 12*b* may be housed into the holes 22*b*, so that the keyboard device 200 can become thin. Instead of the gear links 12*a* and 12*b*, a pantograph-shaped link member may be used, for example.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A keyboard device comprising:

a key top having an upper surface, an opposite, lower surface, and a plurality of first projections extending from the lower surface, wherein the key top is movable between a depressed position and a non-depressed position;

a pair of link members, each including arms, each of which arms has an upper proximal portion attached to links rotatably coupled with the first plurality of projections of the key top, an opposing distal portion having teeth, and second projections extending inwardly from the arms;

a support panel that is located below the key top, has a planar top surface and has a plurality of first through-holes, a plurality of second through-holes, a plurality of third through-holes, and a portion of the support panel extending between the second and third pluralities of through-holes;

a housing between the support panel and the key top and between the pair of link members, said housing having a plurality of bases extending therefrom, wherein each of the link members is rotatably supported by the second projections being received above the support panel by the housing;

a member above the support panel and below the key top having at least one through-hole formed therein over the plurality of first, second and third through-holes of the support panel, the member including a rubber operating member that is received within the housing and biases the key top into the non-depressed position; and a switch located between the support panel and the rubber operating member which is activated when the key top is in the depressed position, wherein the at least one through-hole of the member receives the plurality of bases of the housing therethrough, and the plurality of first through-holes of the support panel receives the bases of the housing therein, respectively, when the key top is in the depressed and non-depressed positions, wherein the at least one through-hole of the member receives the first projections of the key top therethrough, and the plurality of second through-holes of the support panel receives the first projections of the key top therein, without the first projections of the key top contacting the support panel, when the key top is in the depressed position, and wherein the at least one through-hole of the member receives the distal portions of the arms therethrough, and the plurality of third through-holes of the support panel receives the distal portions of the arms therein, without the distal portions of the arms contacting the support panel, but with the proximal portions of the arms contacting the portion of the support panel, when the key top is in the depressed position.

2. The keyboard device as claimed in claim 1, wherein the teeth of the link members are coupled with each other.

3. The keyboard device as claimed in claim 1, wherein each of the distal portions of the link members does not project from a bottom surface of the support panel opposite to the planar top surface of the support panel.

4. The keyboard device as claimed in claim 1, wherein each of the plurality of first projections of the key top does not project from a bottom surface of the support panel opposite to the planar top surface of the support panel.

5. A keyboard device, comprising:

a key top including coupling portions projecting from an undersurface of the key top;

a pair of link members, each including upper ends to be coupled with one of the coupling portions of the key top, teeth, and edge portions between the upper ends and the teeth and adjacent the teeth; and a support panel that is located below the key top, to which the pair of link members are rotatably fixed, that has a single planar top surface and that includes first holes and second holes formed in the planar top surface and extending below the planar top surface, wherein the first holes are separated from the second holes by portions of the support panel, the first holes being separated from each other in the planar top surface and the second holes being separated from each other in the planar top surface, wherein each of the first holes receives respective ones of the edge portions therein, and each of the coupling portions enters into a respective one of the second holes, when the key top is in a depressed position.

6. The keyboard device as claimed in claim 5, further comprising:

a sheet member provided above the support panel, and having third holes formed to extend through the sheet member, wherein one of the third holes opens to one of the first holes and one pair of the second holes, and another of the third holes opens to another of the first holes and another pair of the second holes, wherein each of the first holes receives the respective ones of the edge portions of the link members through the third holes and each of the second holes receives the respective ones of the coupling portions through the third holes, when the key top is in the depressed position.

7. The keyboard device as claimed in claim 5, further comprising:

a member above the support panel and below the key top having at least one through-hole formed therein over each of the first holes and each of the second holes.

* * * * *